US005577365A

United States Patent [19]

Reuteler

[11] Patent Number: 5,577,365

[45] Date of Patent: Nov. 26, 1996

[54] CARTON ENGAGING ASSEMBLY AND METHOD

[75] Inventor: Urs Reuteler, Kennesaw, Ga.

[73] Assignee: Riverwood International Corporation, Atlanta, Ga.

[21] Appl. No.: 503,293

[22] Filed: Jul. 17, 1995

[51] Int. Cl.[6] ..... B65B 21/00

[52] U.S. Cl. ..... 53/398; 53/491; 53/48.8; 53/48.6; 53/377.2; 53/377.5; 493/359; 493/370; 493/426

[58] Field of Search ..... 53/398, 491, 48.6, 53/48.7, 48.8, 48.9, 376.4, 377.2, 377.5, 234; 493/426, 425, 353, 357, 359, 370, 369

[56] References Cited

U.S. PATENT DOCUMENTS

| | | | |
|---|---|---|---|
| 3,013,796 | 12/1961 | Currie, Jr. et al. | 53/48.9 |
| 3,032,945 | 5/1962 | Currie, Jr. et al. | 53/48 |
| 3,254,470 | 6/1966 | Currie, Jr. | 53/48 |
| 3,404,505 | 10/1968 | Hohl et al. | 53/398 |
| 3,701,231 | 10/1972 | Standley | 53/48.9 |
| 4,554,778 | 11/1985 | Calvert | 53/398 |
| 4,563,853 | 1/1986 | Calvert | 53/48 |
| 4,612,753 | 9/1986 | Taylor et al. | 53/398 |
| 4,805,375 | 2/1989 | Langen et al. | 53/377.2 |
| 4,823,536 | 4/1989 | Manservigi et al. | 53/234 |
| 4,970,843 | 11/1990 | Louret et al. | 53/48 |
| 5,392,586 | 2/1995 | Imai | 53/234 |

FOREIGN PATENT DOCUMENTS

| | | | |
|---|---|---|---|
| 3201222 | 7/1983 | Germany | 53/234 |
| PCT/US94/10787 | 3/1995 | WIPO | B65B 2/24 |

*Primary Examiner*—John Sipos
*Assistant Examiner*—John Paradiso

[57] ABSTRACT

A carton engaging assembly for use in continuous motion packaging machines is designed to perform specific functions on a carton as it moves continuously along the path of travel through the packaging machine. The carton engaging assembly includes mechanisms for aligning the carton engaging device perpendicular to the carton's path of travel and to the carton side wall, so that the engaging device enters and exits the carton side wall along the substantially perpendicular line of travel. The carton engaging assembly is a self-contained, rotary unit which is readily interchanged with other units to facilitate engagement with various sizes and shapes of cartons. The rotational movement of the carton engaging assembly is timed with the continuous linear movement of the carton along the carton path of travel.

20 Claims, 8 Drawing Sheets

CARTON ENGAGING ASSEMBLY AND METHOD

FIELD OF THE INVENTION

This invention relates to devices used to engage cartons, principally paperboard cartons or carriers processed in continuous motion packaging machines. The invention can be used in various types of carton engaging devices, including devices that punch, fold, bend, move, or cut various components of a carton during the packaging operation. The invention is ideally suited for devices which engage a carton while the carton is moving along a path of travel through the packaging machine.

BACKGROUND OF THE INVENTION

Continuous motion packaging machines, such as those machines which package articles such as beverage containers or food containers, typically group a selected number of articles into a desired configuration, and package those articles in a carton or carrier formed from a paperboard blank. In the example of beverage containers, such as bottles or cans, the articles are grouped into a predetermined configuration, and either moved singularly or in mass into an open paperboard blank. Otherwise, the paperboard blank is folded around the preconfigured article group. In either case, the packaging of the article group into the paperboard blank occurs while the article group is being conveyed along a path of travel from an infeed area to an outfeed area. This allows the articles to be packaged in a continuous operation, which normally carries on without interruption.

During or after this packaging step, various operations that require mechanical engagement by the packaging machine with the carton can occur. These operations may differ, depending upon the type of carton being utilized. Such carton engaging operations include punching certain areas of the carton, pushing into the carton and folding flaps into a particular orientation, bending the carton, or pushing opposed portions of the carton together in order to complete the article packaging step. In many of these operations, a machine component must engage a specific area or part of a carton in a particular manner to accomplish the desired process step. Considering that the operation must be accomplished while the carton is in continuous movement along a path of travel, often at high speeds, and that only a specific area must be engaged, the engaging mechanism must be designed to operate in timed relationship with the moving cartons. Additionally, some engaging actions or moving cartons tend to adversely impact the cartons, for example, by tearing portions of the cartons, since the cartons are being continuously pushed along by another mechanical device as the device is engaged.

Since typically the engagement operation takes a certain amount of time to complete and is not accomplished instantaneously, it is known that the engaging device must track the carton movement for a sufficient time to enable the process step to be accomplished. This allows, for example, an engaging device to be pushed into the carton, manipulated to accomplish the desired result, and then retracted from the carton, all of which steps take a certain amount of time, while the device is being moved along the path of travel in synchronization with the carton.

One such mechanism for accomplishing this is disclosed in U.S. Pat. No. 4,563,853 to Calvert. This mechanism discloses a device which engages a carton to effect folding of a leading and a trailing flap. Considering that the entire process step requires a specific amount of time to fully complete, the mechanism is designed to track the carton movement for at least the time required to complete the operation. The device is mounted onto a chain conveyor which is driven along the carton path of travel, and in timed synchronization with and aligned with specific areas of the carton. Carton engaging devices which are mounted onto such an elongate drive chain driven along the path of travel, however, include inherent problems. One problem resides in the fact that such systems are not readily interchangeable or adjustable to accommodate various carton sizes or shapes. For example, in many packaging machines now marketed, the machine is selectively adjustable to package various bottle sizes, styles, and shapes. Such an adjustment to a different carton necessarily will change the spacing of successive cartons and the operation required by the carton engaging apparatus. More specifically, the carton engaging pin of a tabbed locking mechanism will be spaced and timed differently for a carton comprising three rows of products than for a carton comprising four rows of products. Changeover to engage other types of cartons may require either disassembly and reassembly of the entire conveyor, or the inclusion of a chainphasing mechanism.

Another type of carton engaging apparatus of the prior art is disclosed in U.S. Pat. No. 4,612,753 to Taylor et al. This patent discloses a tab locking mechanism which utilizes a rotary wheel and cam arrangement, driving spaced carton engaging mechanisms, rather than the elongate chain conveyor of the prior art. The device utilized in U.S. Pat. No. 4,612,753 includes individual tab locking mechanisms or folders which are circumferentially spaced around a drive wheel, and each of which are radially movable with respect to the drive wheel axis. The device also includes brackets or fingers which were biased apart to complete the folding movement. Such rotary cam and drive wheel mechanisms provide for easier and quicker changeover to accommodate different carton styles and sizes, and eliminate the chain conveyor and its many associated elements.

Another device which utilizes the essentially identical concept of U.S. Pat. No. 4,612,753, is disclosed in PCT Patent Application No. PCT/US94/10787. The device disclosed in this application, however, forces the spaced, circumferentially mounted article engaging devices into the carton by forming the devices into a star arrangement and placing the main drive wheel directly adjacent to the carton. The drive wheel is rotated in order to angularly force the cone shaped engaging portions into the carton side wall. Thereafter, just as in the prior disclosure to Taylor, the actuating device is moved radially out from the drive wheel to spread apart two fingers and complete the folding operation. As the drive wheel continues to be turned, the actuating mechanism is pulled back into the wheel along its fixed, stationary radial line. One drawback with the device disclosed in this PCT application is that the actuating mechanism and the pivotal fingers are only in normal relationship with the moving carton at a single point in time, as the carton is transported past the engaging device in its continuous movement along the path of travel. This provides a tendency for the carton to be torn or otherwise undesirably impacted during the entering of the carton by the pivotal fingers and especially during the exit of the carton of the pivotal fingers when the mechanism is not at a substantially normal orientation with respect to the carton side wall.

Therefore, while the rotary carton engaging devices have been developed to provide better ease of adjustment or changeover, the devices nevertheless include drawbacks not found in prior chain devices, that is, their limitation to an angular movement and inefficient entry and exit from the carton due to the fixed rotation of the carton engaging device mounted to the drive disk or wheel.

SUMMARY OF THE INVENTION

The present invention comprises an engaging device especially adapted to engage a carton such as a paperboard carrier, and to perform a function on the carton as the carton is continuously being transported through a packaging machine. The device is a self-contained, rotary assembly which is readily interchangeable with other, similar units in order to process different carton sizes and shapes. The carton engaging assembly includes a stationary cam plate which defines cam tracks in one surface, preferably its upper surface. A rotatable drive plate is positioned directly adjacent to the cam tracks defined in the stationary cam plate. The rotatable drive plate defines channels and openings through the plate which are positioned over the respective cam tracks when the plates are positioned together. These openings permit cam followers to extend through the drive plate and into the cam tracks. The rotational movement of the drive plate with respect to the fixed cam plate moves an actuating mechanism into a position normal to the carton path of travel, and then into engagement with the carton. The actuating mechanism is maintained in position throughout the engaging operation. The drive plate carries at least one actuating mechanism in a recess defined in its upper surface adjacent to the circumferential edge of the drive plate. Preferably, however, numerous, spaced actuating mechanisms are carried by the drive plate. These actuating mechanisms are spaced specifically to coincide with particular areas of the carton which must be engaged as the carton passes the carton engaging assembly, in timed relationship with the rotational movement of the assembly.

The actuating mechanism includes a planetary disk which is rotatable within the recess defined in the drive plate. Preferably the planetary disk is received within the recess so that the circumferential edge of the planetary disk overlaps the circumferential edge of the drive plate. The planetary disk includes a cam follower which extends through an opening in the drive plate so that the cam follower is received within the outer cam track defined in the stationary cam plate. The outer cam track is specifically designed to cause the planetary disk to move in a particular manner as the drive plate turns across the cam plate. The planetary disk defines a channel in its upper surface, the midpoint of which channel generally corresponds to the diameter of the planetary disk. An elongate slide plate is received in the channel so that the slide plate can be actuated back and forth across the surface of the planetary disk, toward and away from the carton which is intended to be engaged.

The slide plate could be in the form of a punch, a cutting member, or a folding member in order to accomplish a specific function on the carton. Another example of the device includes the actuating mechanism designed to fold a tab in order to lock the articles in place. If a folding movement inside the carton is desired, the slide plate can carry levers which are biased outwardly, away from one another to accomplish the folding step. These levers are pivotally attached to the slide plate, and include lever cam followers extending into cam tracks also defined in the upper surface of the planetary disk. The back and forth movement of the slide plate causes the levers to pivot about their fixed pivot pins on the slide plate, and rotate through a range of motion caused by the offset cam follower traveling in the planetary disk cam track. The slide plate itself is caused to be moved back and forth by a cam follower extending from its proximal end through the drive plate and into the stationary cam plate. Thus, the rotational movement of the drive plate is the primary driving means for all the moving elements of the carton engaging assembly. The drive plate, itself, is driven by a servo motor controlled to rotate in timed relationship with the main conveyor of the packaging machine.

The present invention is uniquely designed to orient the actuating mechanism normal to the longitudinal axis of movement of the carton past the rotating drive plate for a sufficient time to accomplish the carton engaging operation effectively. This orientation is desired, since the movement of the engaging mechanism into and out of the moving carton occurs most efficiently and without causing damage to the carton if the engaging device moves along the path of travel perpendicular to the carton, while tracking the linear motion and speed of the carton moving along its path of travel. To accomplish this, the planetary disk, along with its diametrically oriented slide plate, is rotated so that the slide plate is normal to the carton path of travel prior to the slide plate's engaging the carton. The planetary disk is continued to be positioned so that the slide plate is kept at this normal orientation during substantially the entire engaging operation, while the drive plate itself is being rotated in a substantially circular movement. This tracking of the carton's linear motion allows the present invention, comprised of an easily interchangeable mechanism, to incorporate the advantage of ease of changeover while also keeping the advantage of the prior art chain systems which, although were cumbersome and difficult to change over, inherently incorporated the tracking of the carton's linear movement. When changeover is desired, for example if similar cartons having different spaced engagement areas are run, the engaging assembly is simply removed from the motor drive disk, and a different unit is installed.

DETAILED DESCRIPTION OF THE PREFERRED EMBODIMENT

Figure 1:
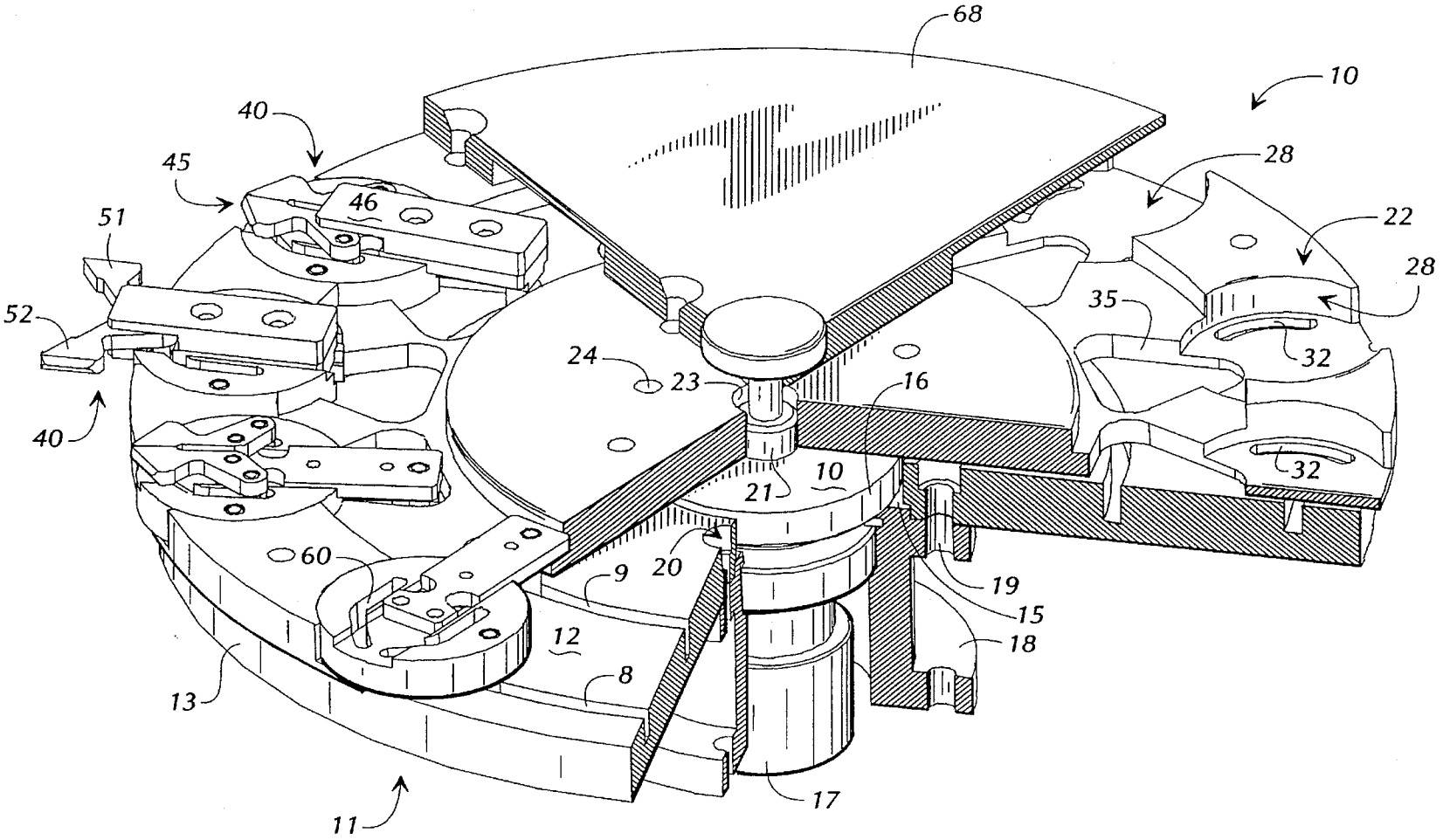
FIG. 1 is an elevated, fragmentary perspective view of one embodiment of the present invention.

FIG. 1 shows one embodiment of the carton engaging assembly of the present invention. The embodiment shown in FIG. 1 comprises a tab locking device, although as discussed hereinafter many other types of carton engaging assemblies readily can incorporate the novel aspects of the present invention. In the embodiment of FIG. 1, however, carton engaging assembly 10 is intended to progressively advance a slide plate carrying opposed levers into the side wall of a paperboard carton, thereby pushing predefined flaps inwardly. As the levers continue to spread apart once inside the carton, the flaps are pushed outwardly to a fully extended position. The levers are then brought back together, and the slide plate is pulled back, away from the carton side wall and into the carton engaging assembly 10.

Figure 2:
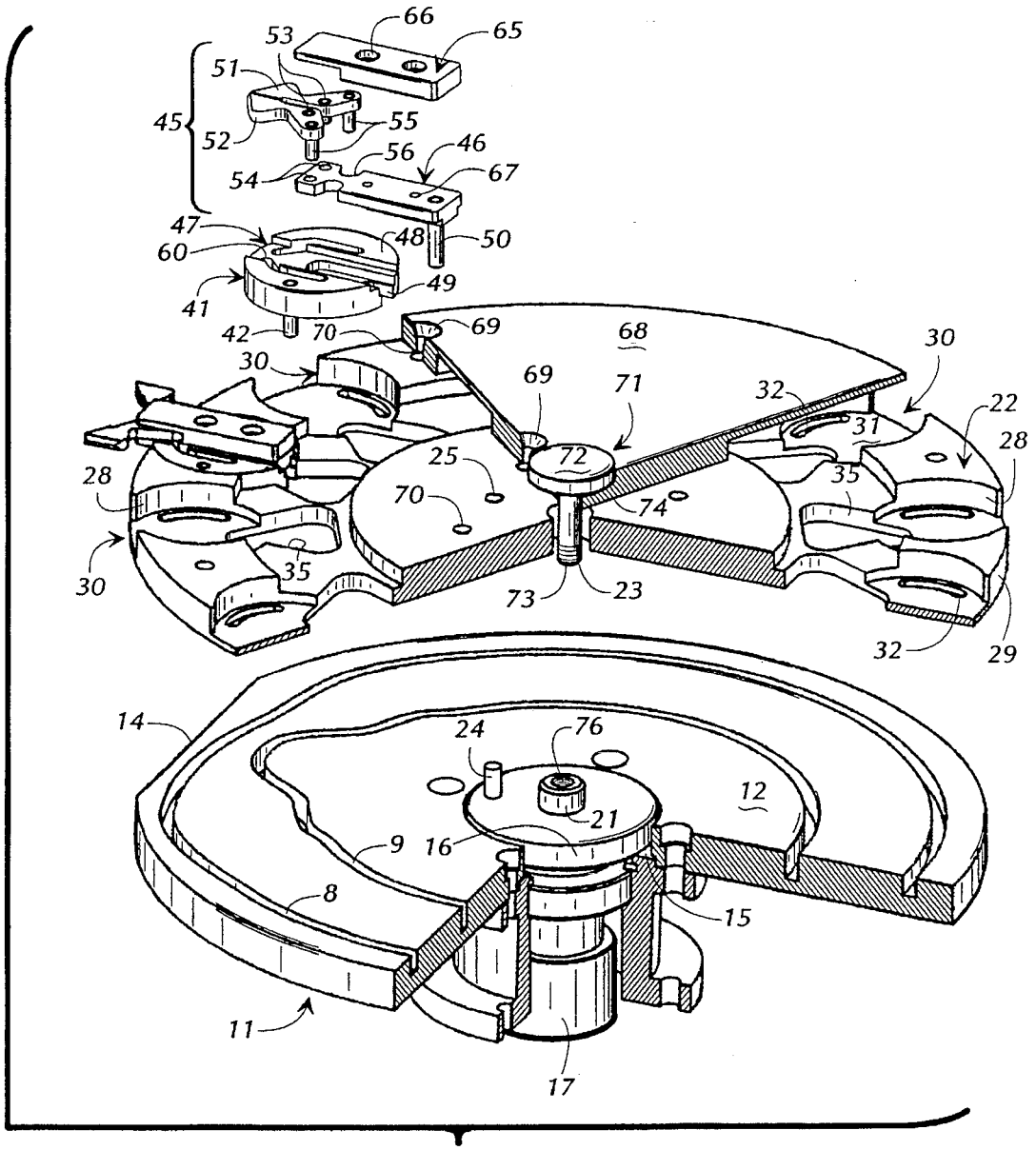
FIG. 2 is a fragmentary, exploded view of the embodiment of FIG. 1.

The first embodiment chosen for illustration, therefore, includes a fixed or stationary cam plate or disk 11, having an upper surface 12 and defining a substantially circumferential outer edge 13. Cam plate 11 is generally circular as shown in FIG. 2, although it can include flattened edge areas such as edge 14, as long as the flattened areas do not interfere with the cam tracks, discussed hereinafter. Cam plate 11 defines central opening 15 which receives drive disk 16. Disk drive 16 is spaced from cam plate 11 to allow free rotation in opening 15 without impinging on plate 11. Operatively connected to drive disk 16 along one side is motor 17. Stationary flange 18 engages motor 17 along its outer side, as shown in FIG. 1, and also is connected to stationary cam plate 11 at several locations by bolts (not shown) extending through bores 19 in flange 18 and bores 20 in drive disk 11. Thus, stationary cam plate 11, motor 17 and flange 18 are connected together as a fixed, unmoving unit. Also as shown in FIG. 1, drive shaft 21 extends upwardly through drive disk 16 from motor 17. Drive shaft 21 and drive disk 16 are connected by a pin, a key (not shown) or other suitable mechanism so that drive plate 16 rotates with the rotation of shaft 21.

A rotatable drive plate 22 is positioned to rest on the top surface of drive disk 16 as shown in FIG. 1. Drive plate 22 is substantially circular, and defines central opening 23 that receives upstanding drive shaft 21 when plate 22 is positioned over drive disk 16. An upstanding dowel rod 24 is eccentrically mounted to the top surface of drive disk 16 as shown in FIG. 2. When drive plate 22 is properly placed onto drive disk 16, the dowel rod 24 extends upwardly into corresponding eccentric opening 25 defined in the inner section of drive plate 22. Dowel rod 24 functions to transfer the torque from drive shaft 16 to drive plate 22 as the motor 17 rotates drive plate 16. Since cam plate 11 is mounted to flange 18 and spaced away from drive disk 16, the rotation of drive disk 16 will not move or rotate stationary cam plate 11. The rotation of drive disk 16, however, will cause drive plate 22 to rotate therewith.

Drive plate 22 defines recesses 28 adjacent to its circumferential edge 29. Recesses 28 are substantially circular, and define space openings 30 so that the recesses 28 can be considered to open outwardly at spaced openings 30 along edge 29. Defined in the bottom walls 31 of recesses 28 along one side, as shown in FIG. 2, are curved channels 32. Channels 32 function to allow cam followers, as discussed hereinafter, to extend through bottom wall 31 of the recesses 28 and into a cam track. Also defined through plate 22 inwardly or rearwardly of recess 28 toward central opening 23 is triangular cavity 35. A cavity 35 is defined inwardly of each recess 28, and also is designed to permit a cam follower to extend through drive plate 22 and into a cam track defined in cam plate 11.

Each recess 28 of drive plate 22 carries an individual actuating mechanism 40. The purposes of the actuating mechanism are to carry a carton engaging member, and to selectively move the carton engaging member into position and into engagement with the carton. Actuating assembly or mechanism 40 includes a planetary disk 41 which is sized slightly smaller than substantially circular recess 28 so that it rotates freely within a selected angular range of motion when disk 41 is received in recess 28. Disk 41 includes cam follower 42 which is mounted eccentrically to disk 41 as shown in FIG. 2, and which extends downwardly through channel 32 when disk 41 is received in recess 28.

When the above components are mounted adjacent to one another as described above, cam follower 42 extends through channel 32 and into an outer cam track 8 defined in upper surface 12 of cam plate 11. The rotational movement of drive plate 22 with respect to fixed cam plate 11 causes cam follower 42 to move along outer cam track 8. The design of cam track 8, therefore, can be implemented to achieve movement in cam follower 42 to control the rotation of planetary disk 41 within a specifically desired angular range of movement. In other words, planetary disk 41 can be caused to be selectively rotated within recess 28 by the action of drive plate 22 turning above fixed cam track 8. The exact angular motion of planetary disk 41, as drive plate 22 is rotated 360° , is discussed below.

Planetary disk 41 also includes carton engaging device or means 45. Engaging device 45 includes slide plate 46 which is slidably received within channel 47 defined in the upper surface 48 of planetary disk 41. Channel 47 generally is aligned with the diameter of disk 41. Below channel 47 is a cut out area 49 which extends through planetary disk 41, as shown in FIG. 2, to permit a cam follower to extend through disk 41. This cam follower, follower 50, extends downwardly from the rear end section of slide 46. When slide 46 is slidably received within channel 47 of disk 41, and disk 41 is received within recess 28 of disk 22, which in turn is mounted adjacent to cam plate 11, cam follower 50 extends through cavity 35 and into inner cam track 9 defined in the upper surface 12 of stationary cam plate 11. Therefore, inner cam track 9 can be specifically designed in order to effect movement of slide plate 46 with respect to planetary disk 41 outwardly and inwardly toward the central section of drive plate 22. This linear movement of slide plate 46, as effected by cam track 9 through a full 360° rotation of drive plate 22, is discussed below.

In the embodiment shown in FIG. 2, carton engaging device 45 includes two opposed levers 51 and 52, respectively. Levers 51 and 52 generally are S-shaped, and are pivotally mounted by pins 53 positioned toward each of the central section of levers 51 and 52, respectively, to the distal or outer end of slide plate 46. Pins 53 therefore extend downwardly into respective openings 54 defined in slide plate 46 so that levers 51 and 52 pivot on plate 46. Cam followers 55 are mounted to the respective proximal or inner ends of levers 51 and 52, and extend downwardly through opposed recesses 56 also defined in the distal end of slide plate 46 inwardly of openings 54. When the above-referenced components of carton engaging device 45 are assembled, cam followers 55 extend into cam tracks 60 defined in the upper surface 48 of planetary disk 41. Cam tracks 60 generally are L-shaped, inwardly extending tracks as shown in FIG. 1 and FIG. 2. The outward movement of slide plate 46, which carries levers 51 and 52 in pivotal engagement, causes cam followers 55 to slide in fixed, angled cam track 60. This causes the distal or outer ends of levers 51 and 52 to be biased away from one another. The return movement of slide plate 46 through channel 47 back toward the central section of drive plate 22 causes levers 51 and 52 to pivot towards one another, until the respective distal ends of the levers come in contact with one another and close to together form an apex or triangular outer end.

A slide lever cover 65 is positioned over slide plate 46 and levers 51 and 52. Cover 65 is fastened to slide plate 46 with bolts (not shown) passing through holes 66 defined in cover 65 and into corresponding threaded holes 67 defined in plate 46. A second cover, assembly cover 68, which generally corresponds in shape to the shape of drive plate 22, is placed over drive plate 22 and all of the above-described elements. Assembly cover 68 is fastened to drive plate 22 by bolts (not shown) passing through opening 69 defined in assembly cover 68 and into threaded holes 70 defined in drive plate 22. A handle 71 having knob 72 and externally threaded shank 73 passes through central opening 74 defined by cover 68, and central opening 23 defined by plate 22 to be received in internally threaded, axial bore 76 of drive shaft 21. Knob 72 functions to hold the above elements onto the drive disk 16 and drive shaft 21.

Figure 3:
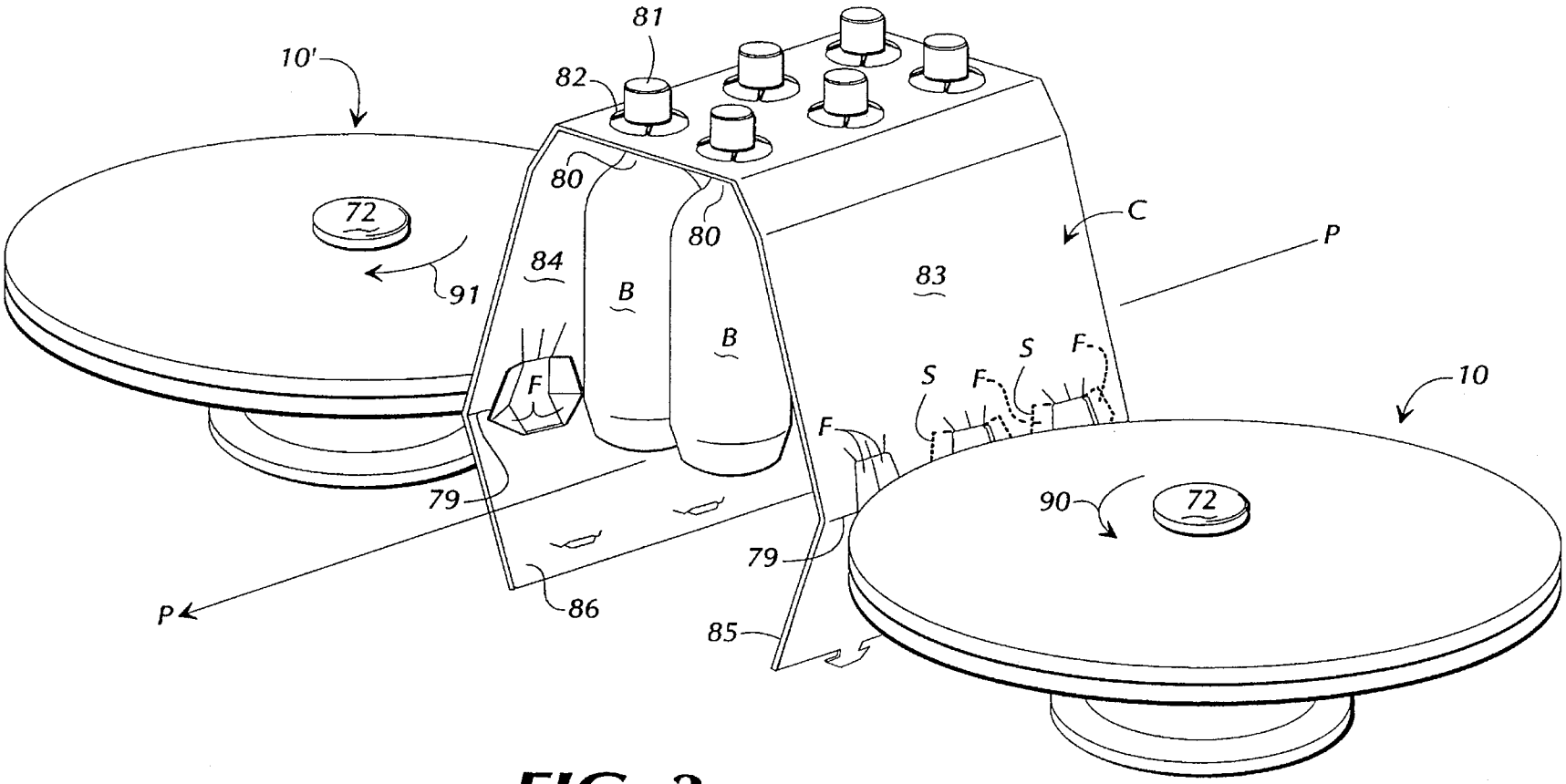
FIG. 3 is a schematic perspective view of two opposed carton engaging assemblies positioned on either side of a moving paperboard carton.

Some packaging machine operations which include a carton engaging process, perform the carton engaging step on more than one side of the cartons. The tab locking process accomplished by the carton engaging device illustrated above, is one of these processes which simultaneously takes place on opposed side walls of the carton. FIG. 3 schematically illustrates a paperboard carton C being continuously pushed along a longitudinal path of travel P by packaging machine lugs (not shown). The process illustrated in FIG. 3 shows a part of a packaging operation during which time the paperboard carton blank C is in the process of being wrapped around a group of bottles B. The bottle group illustrated is a two row by three column, six pack configuration. This process of wrapping the paperboard carton around the bottle group as shown in FIG. 3 is well known in the art and includes placing the carton C over the bottle necks 80 so that the portion of the bottle necks 80 and the bottle caps 81 protrude from both openings 82 in carton C. Such cartons are cut or scored along score lines S to define flaps F in the lower portion of the opposed carton side walls 83 and 84, adjacent to the fold lines 79 that separate side wall 83 from bottom wall 85 and side wall 84 from bottom wall 86. As also is known in the art, prior to the carton bottom walls' being joined together in a later packaging machine step, the flaps F, which when biased inwardly constitute the locking tabs, are engaged by the carton engaging assemblies 10 and 10' positioned on each side of the carton's path of travel P. Therefore, as cartons C in the group of bottles B are continuously pushed along path P as shown in FIG. 3, carton engaging assemblies 10 and 10' are rotated in the direction of movement of cartons C along path P, the rotational direction of opposed assemblies 10 and 10' being denoted by numerals 90 and 91, respectively. The engagement of the opposed carton side walls 83 and 84 by respective carton engaging assemblies 10 or 10', occurs on the specific areas of carton C at which flaps F are scored, and as carton C is pushed between assemblies 10 and 10'.

Figure 4:
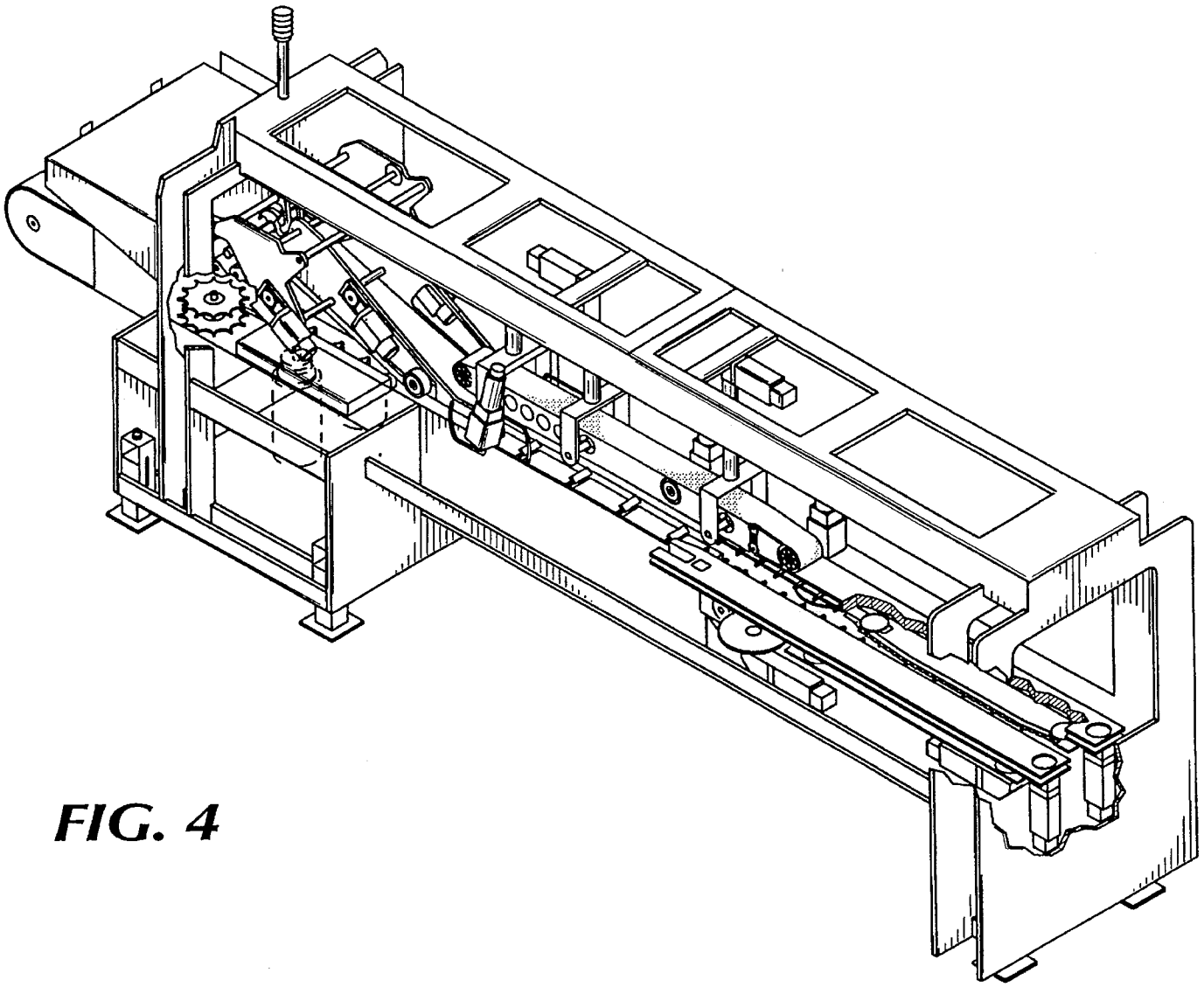
FIG. 4 is a schematic perspective view of a packaging machine incorporating one embodiment of the present invention.

FIG. 4 schematically illustrates a packaging machine 87 with infeed end 88 and outfeed end 89 transporting cartons C along path of travel P. Carton engaging assemblies 10 and 10' are shown disposed on each side of path P of packing machine 87.

Figure 5B:
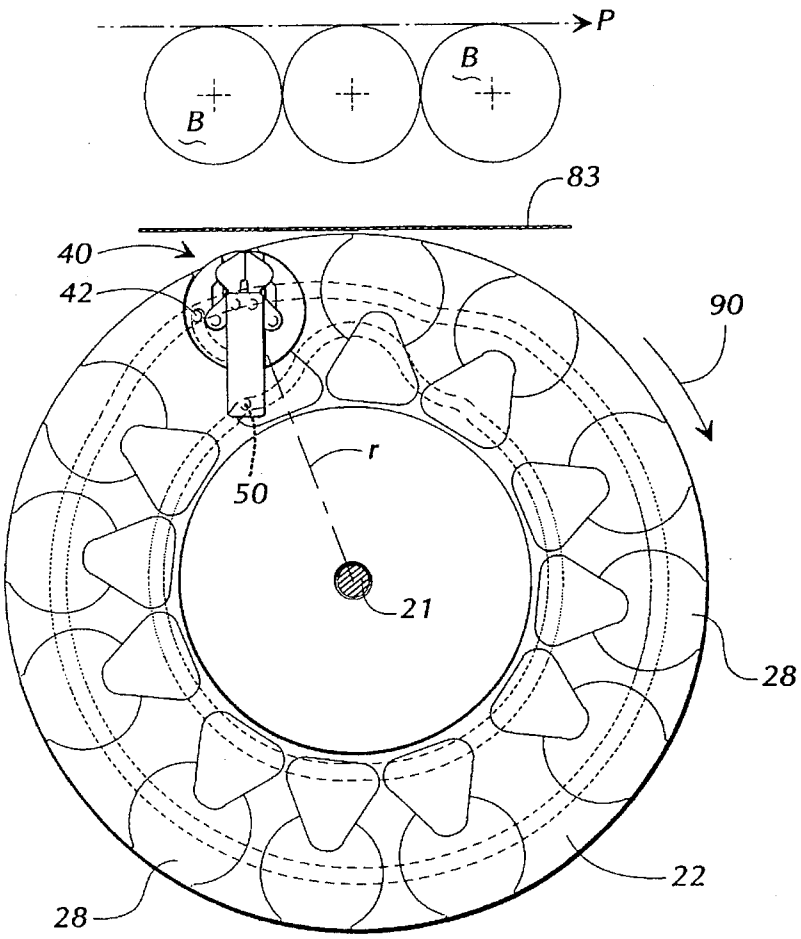
FIGS. 5A–5F are schematic plan views of the embodiment of FIG. 1, in various stages of movement.
Figure 5A:
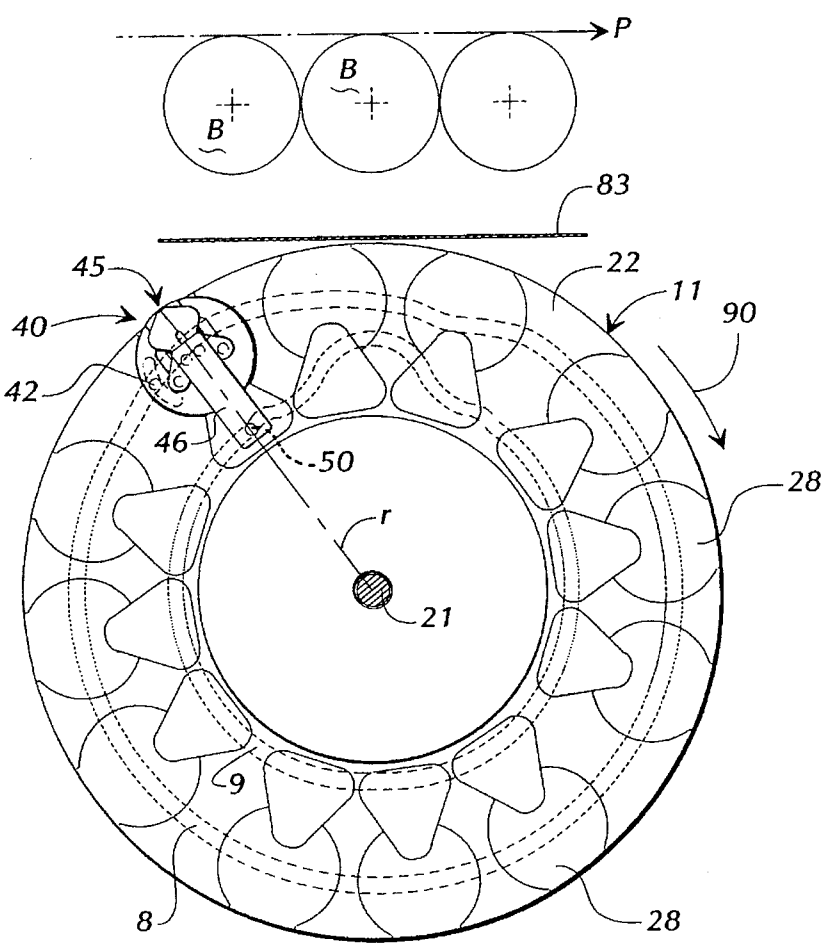

FIGS. 5A–5F schematically show the movement of a carton actuating mechanism 40 as drive plate 22 is rotated through approximately 120° of angular rotation. In FIG. 5A, cam plate 11 is shown defining outer cam track 8 and inner cam track 9 in upper surface 12 of the cam plate. In FIGS. 5A–5F, assembly 10 is disposed directly adjacent to side wall 83 of carton C. Three bottles B representing one row of the six pack configuration are shown. While in FIGS. 5A–5F only one actuating mechanism 40 is schematically shown, each recess 28 typically includes an actuating mechanism 40.

In FIGS. 5A–5F, actuating mechanism 40 is progressively being rotated toward side wall 83 of carton C. At the point shown in FIG. 5A, the slide plate 46 is aligned with the radial line r of cam plate 11, and is fully retracted toward drive shaft 21. At this position, cam follower 50, which moves in inner cam track 9, is still in the circular or nonactuating section of cam track 9. Cam track 9 controls the movement of slide plate 46 toward and away from drive shaft 21 and toward and away from carton side wall 83, respectively. Also at this position, cam follower 42 of planetary disk 41, which moves in outer cam track 8, is still in the circular or nonactuating section of cam track 8. As discussed above, drive plate 22 operatively pushes actuating mechanism 40 and its associated elements, including carton engaging device 45, through a rotary path of travel around drive shaft 21 in the direction of arrow 90.

FIG. 5B shows actuating mechanism 40 having been pushed further around the center point defined by drive shaft 21 in the direction of arrow 90. In FIG. 5B planetary disk 41, itself, has been rotated by the action of cam follower 42 riding in outer cam track 8. In FIG. 5B, cam follower 42 has entered a section of cam track 8 which deviates from the substantially circular, nonactuating section of cam track 8, so that planetary disk 41 also is rotated in the direction of arrow 90. This causes carton engaging device 45 to be rotated along with disk 41, so that its longitudinal axis no longer is in alignment with the radius r of drive plate 22. Instead, the longitudinal axis of carton engaging device 45, and specifically the longitudinal axis of slide plate 46, is substantially normal to side wall 83 of carton C. At this point, cam follower 50 of slide plate 46 still is in the substantially circular nonactuating section of inner cam track 9, so that slide plate 46 still is in its innermost or retracted position. In the rotated position of actuating mechanism 40 shown in FIG. 5B, however, the carton engaging device 45 is now aligned so as to most efficiently engage and enter carton C.

Figure 5D:
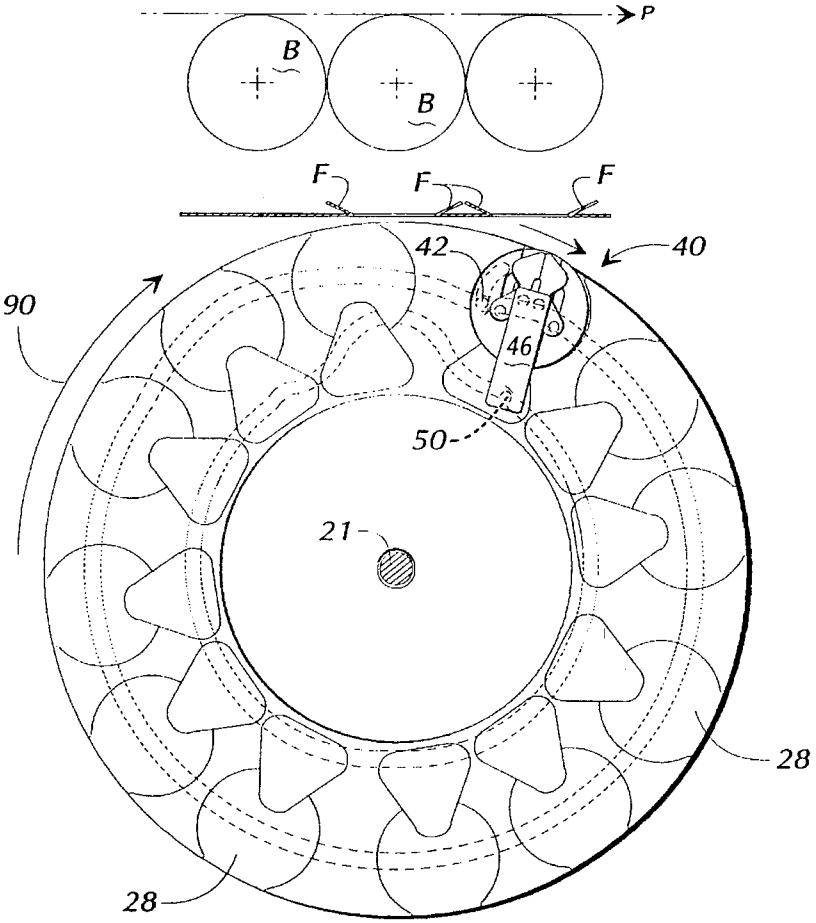
Figure 5C:
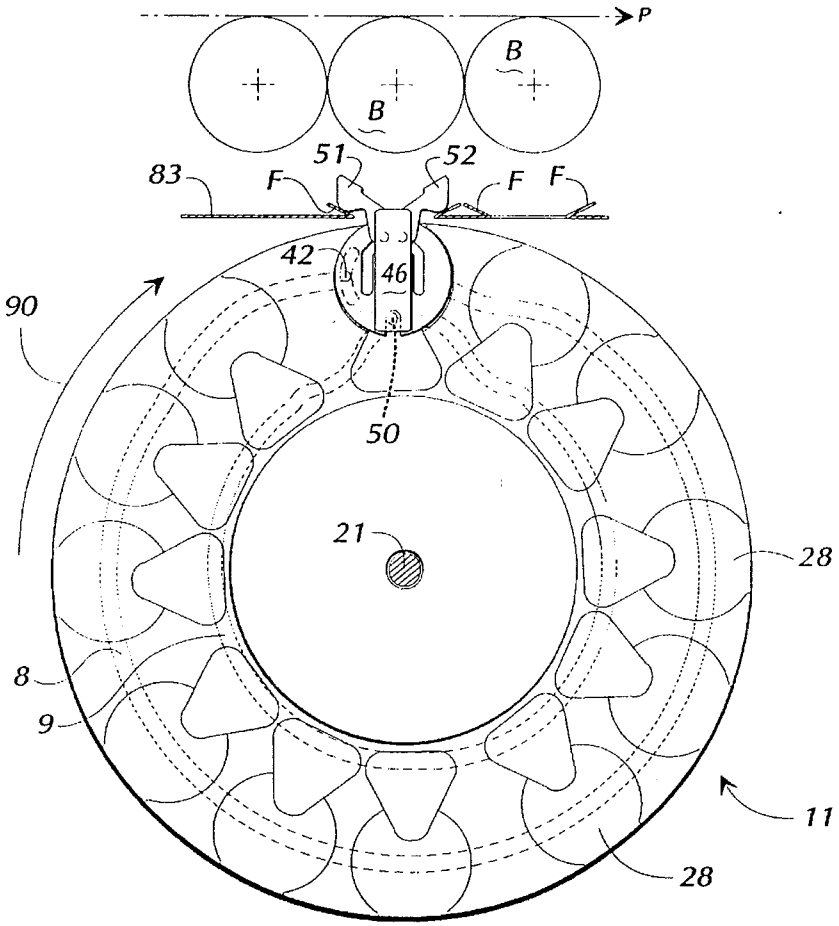

FIG. 5C shows actuating mechanism 40 in a position further advanced along the direction of rotation 90 about shaft 21. In FIG. 5C, mechanism 40 is moved to approximately the 12 o'clock position the closest it can be moved toward the side wall 83 of carton C. In this position, slide plate 46 still is maintained substantially normal to the side wall 83 of carton C, as is controlled by the movement of cam follower 42 in cam track 8. In FIG. 5C, however, cam follower 50 moving in an upwardly curved portion of cam track 9, has caused slide plate 46 to move outwardly from drive shaft 21 and toward carton side wall 83 until levers 51 and 52 have pushed into carton side wall 83 where score lines S define flaps F. Also, slide plate 46 has moved so far outwardly so as to cause levers 51 and 52 to pivot away from each other at their distal ends, since their respective cam followers 55 have been pushed forwardly or outwardly along planetary disk cam track 60, as discussed above. This biasing movement of levers 51 and 52 away from one another at their distal ends causes flaps F, which are being contacted by levers 51 and 52, to be folded inwardly and back toward carton side wall 83. These flaps comprise the locking tabs which assist in locking the bottles in their desired positions after carton side walls 83 and 84 have been folded towards one another and carton bottom walls 85 and 86 have been locked together in a later packaging operation.

Slide plate 46 continues to be held in a position substantially perpendicular to carton side wall 83 by the action of cam follower 42 riding in outer cam track 8, while the continued rotation of drive plate 22 causes cam follower 50 moving in inner cam track 9 to pull slide plate 46 inwardly, toward drive shaft 21 and away from carton side wall 83. The curvature of inner cam track 9, therefore, is designed so that cam follower 50 is now moved inwardly, which also pulls slide plate 46 progressively inwardly so that levers 51 and 52 are biased back together by the action of cam followers 55 riding in cam tracks 60. As slide plate 46 continues to be pulled inwardly, levers 51 and 52 are rejoined to form an apex, and then are pulled completely out of carton side wall 83 and toward drive shaft 21. This movement of plate 46 inwardly toward drive shaft 21 is accomplished entirely while planetary disk 41 is maintaining the longitudinal axis of slide plate 46 perpendicular to carton side wall 83. Therefore, since the engaging elements of actuating mechanism 40 are being pulled from the carton in this manner, the problem with the carton's tearing, as is seen in the prior art when the actuating mechanism is pulled from the carton while in a nonperpendicular alignment, is eliminated.

FIG. 5D shows mechanism 40 having been moved further around shaft 21, and with engaging device 45 being completely retracted from carton side wall 83. Slide plate 46 is now again in its fully retracted position toward drive shaft 21. At this position, planetary disk 41 itself continues to be rotated by the action of cam follower 42 in outer cam track 8 in the direction of arrow 90.

Figure 5F:
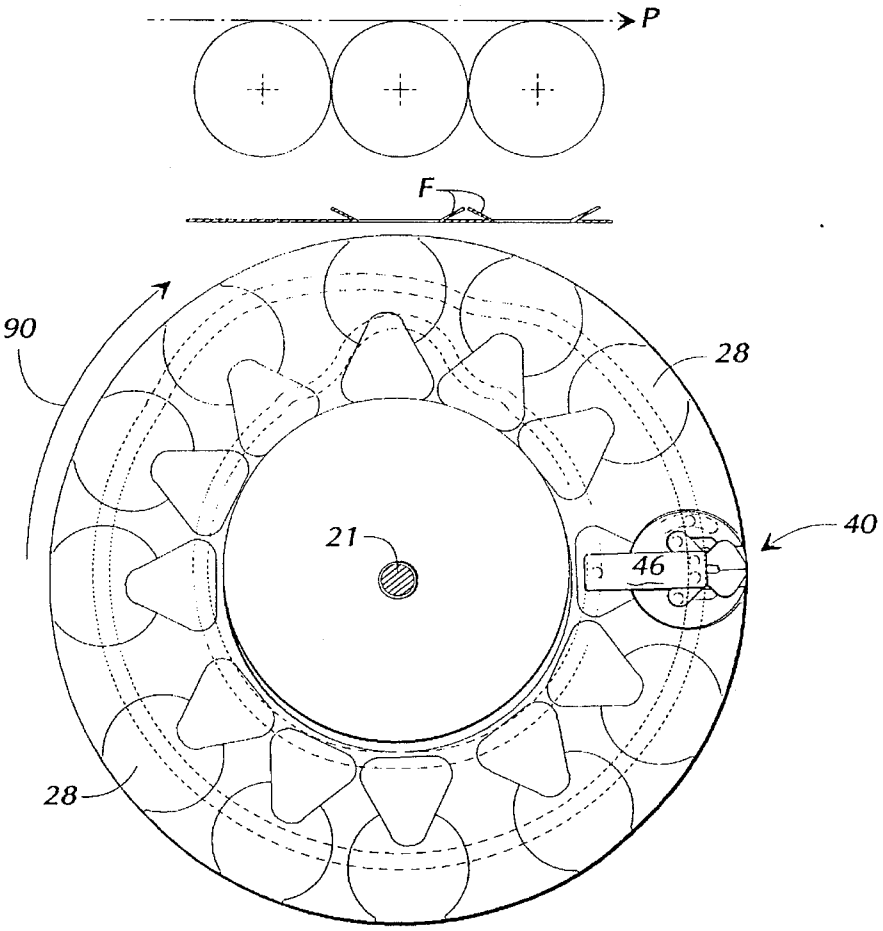
Figure 5E:
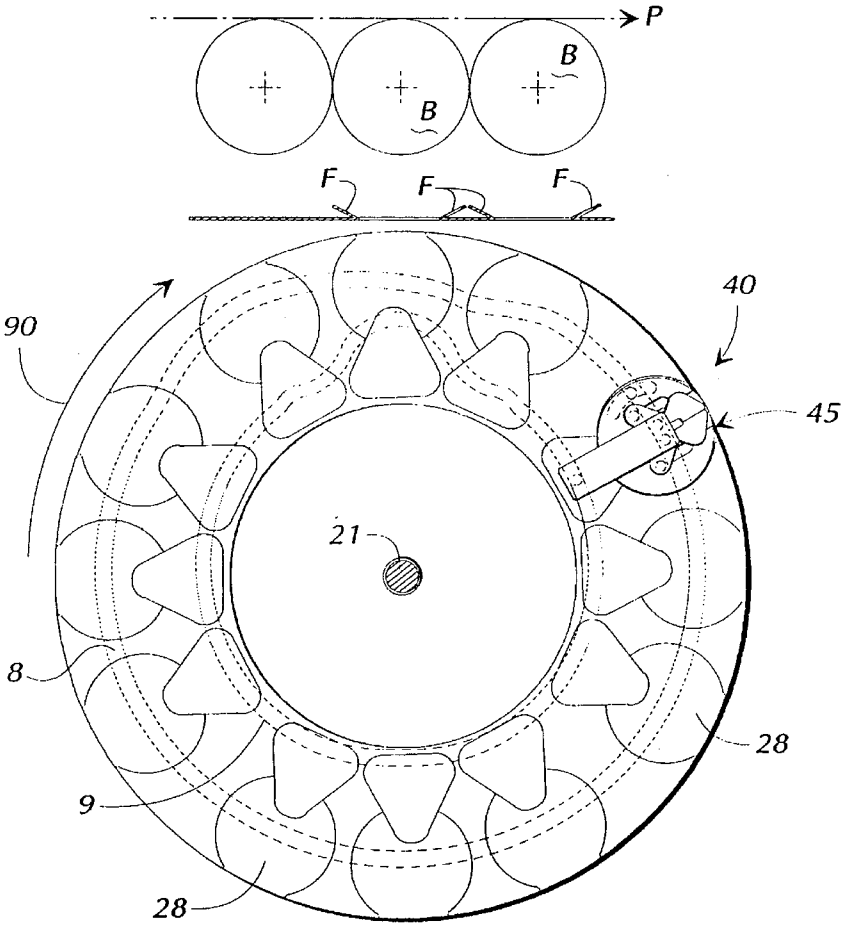

As shown in FIG. 5E, planetary disk 41 itself continues to be rotated, so that the longitudinal axis of slide plate 46 is approaching alignment with radius r of drive plate 22.

FIG. 5F shows actuating mechanism 40 in its fully rotated position, so that the longitudinal axis of slide plate 46 is in substantial alignment with radius r of drive plate 22. The actuating mechanism 40 is held in a position in which slide plate 46 is in substantial alignment with radius r, during the continued rotation of actuating mechanism 40 around drive shaft 21, until actuating mechanism 40 reaches the position shown in FIG. 5A. At this position, planetary disk 41 again begins rotating in the direction of arrow 90, and the above-described motions are repeated.

From the above description, it should be appreciated that the assembly of the present invention accomplishes the carton engaging process while maintaining the specific elements which actually impact or engage the cartons in normal relationship with the carton side wall during the engaging operation.

FIGS. 5A–5F show recesses 28 spaced along the circumferential edge 13 of drive plate 22, which recesses each would contain an actuating mechanism 40. The actuating mechanisms, therefore, are spaced around the circumferential edge 13 of drive plate 22 to coincide with a specific area of the carton which must be engaged while the carton is moving past the carton engaging assembly 10. The rotation of drive plate 22, as controlled by servo motor 17, is controlled by a main controller (not shown) so that its rotation is timed to coincide with the linear movement of carton C through the packaging machine. This, along with proper spacing of mechanisms 40, assures that engaging devices 45 will be perfectly aligned with the flap F of carton side walls 83.

As discussed above, other, similar carton engaging assemblies with different spacings can be readily interchanged with carton engaging assembly 10 by removal of assembly 10 from engagement with drive disk 16 and replacement with a different carton engaging assembly having different spacings of actuating mechanisms.

Figure 6:
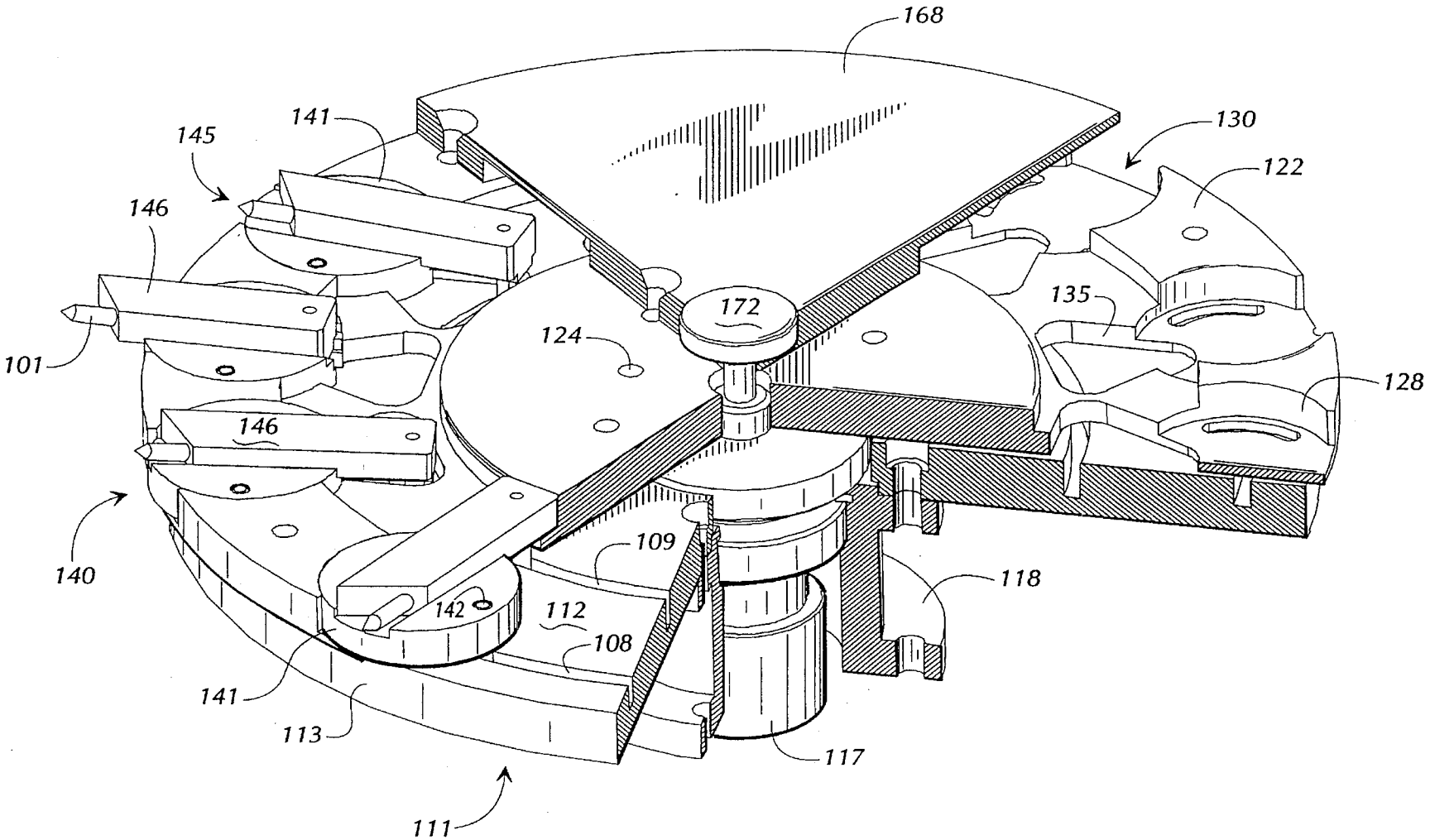
FIG. 6 is a perspective view of another embodiment of the present invention.
Figure 4:
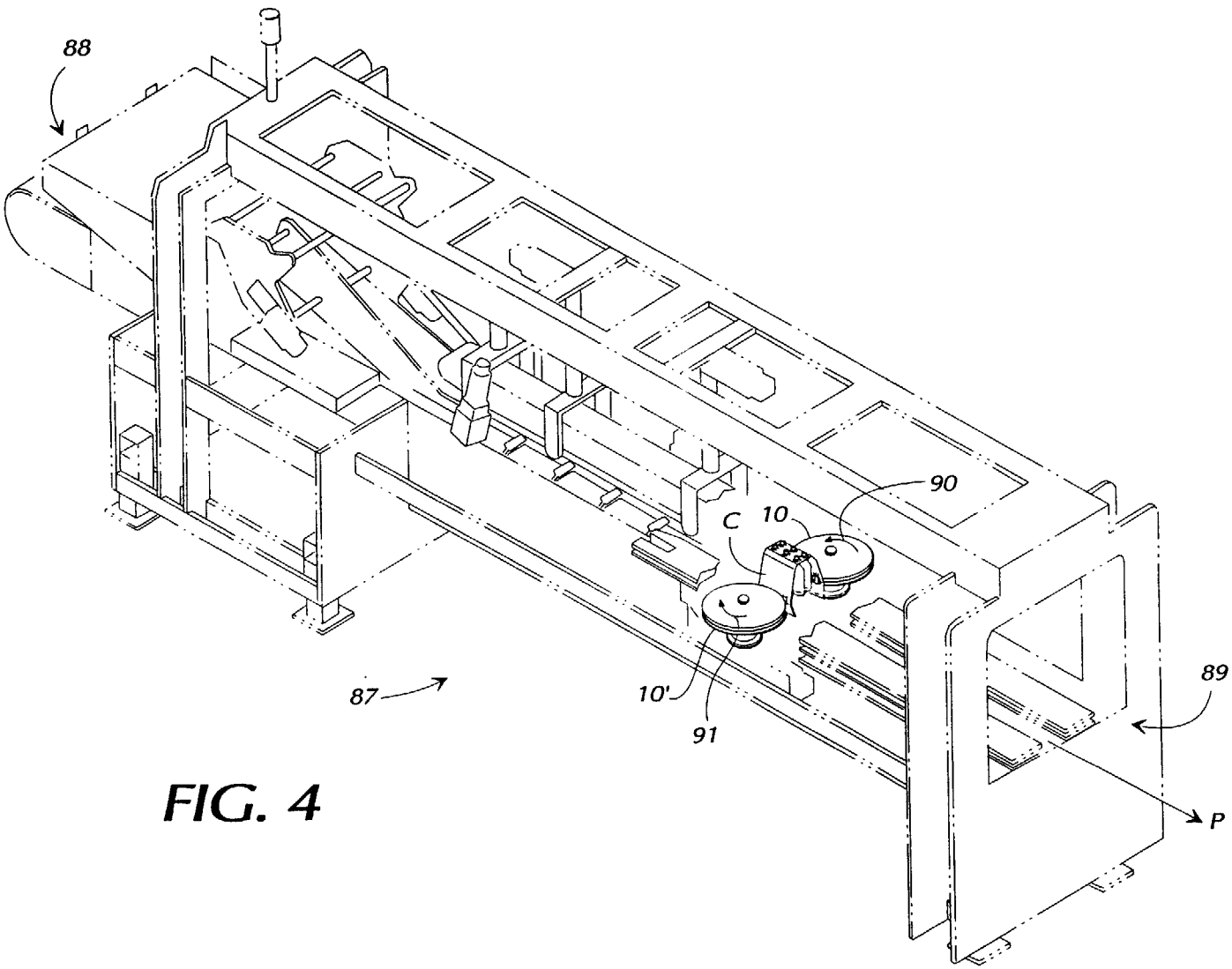

Also as discussed above, the present invention is not limited to a tab locking mechanism, but can be incorporated into many other mechanisms which engage the carton to perform a process on the carton as it is being continuously transported along the path of travel through the packaging machine. FIG. 6 schematically shows another such device which is intended to punch a flap inwardly without accomplishing a flap folding operation, as discussed above with respect to the tab locking mechanism. The elements shown in FIG. 6 and their functions correspond identically with the elements described above, except that the levers 51 and 52 attached to the slide plate are not present, and a punch 101 is instead attached to the slide plate 146. The punch 101 comprising a carton engaging means, could be used to punch a flap, such as a handle flap, or simply a hole in the carton side wall. The planetary disk 141 functions to position the punch 101 normal to the carton wall, moving as described above with respect to disk 41. The carton engaging devices of the present invention can be oriented at virtually any angle with respect to the carton path of travel, and are not required to be oriented horizontally, since the above-described components work together satisfactorily at virtually any orientation.

It will further be obvious to those skilled in the art that many variations may be made in the above embodiments, here chosen for the purpose of illustrating the present invention, and full result may be had to the doctrine of equivalents without departing from the scope of the present invention, as defined by the appended claims.

Wherefore, the following is claimed:

1. In an article packaging machine of the type comprising a conveyor for moving an article group along a path of travel and for packaging said article group into a carton as said article group is moved along the path of travel, a carton flap engaging assembly comprising:

(a) a stationary cam disk having a cam surface, and defining in said cam surface a first cam track and a second cam track spaced from said first cam track;

(b) a rotatable drive plate having an outer edge and disposed adjacent said cam disk, said drive plate defining a recess adjacent said outer edge;

(c) an actuating mechanism carried by said drive plate, said actuating mechanism comprising a planetary disk received in said recess of said drive plate, and carton flap engaging means carried by said planetary disk for engaging said carton flap said planetary disk being rotatable within said recess of said drive plate in response to the rotation of said drive plate for tracking movement of the carton along its path of travel so as to maintain said carton flap engaging means substantially perpendicular to the carton as said carton flap engaging means engages the carton; and (d) drive means operatively connected to said drive plate for selectively rotating said drive plate.

2. The carton flap engaging assembly of claim 1, said carton flap engaging means including a slide plate slidably received by said planetary disk, and finger means for pushing against said carton, said finger means pivotally mounted to said slide plate and including opposed levers capable of biasing toward and away from one another.

3. The carton flap engaging assembly of claim 2, said planetary disk having a first surface and defining a channel in said first surface, said slide plate being received in said channel for slidable engagement with said planetary disk within said channel.

4. The carton flap engaging assembly of claim 2, said planetary disk having a first surface and defining a planetary disk cam track within said first surface, said finger means including a lever cam follower, said lever cam follower being disposed within said planetary disk cam track.

5. The carton flap engaging assembly of claim 1, said planetary disk including a planetary disk cam follower, said planetary disk cam follower being disposed within said first cam track.

6. The carton flap engaging assembly of claim 2, said slide plate including a slide plate cam follower, said slide plate cam follower being disposed within said second cam track.

7. The carton flap engaging assembly of claim 1, said carton flap engaging means including a slide plate mounted to said planetary disk, and opposed levers pivotally attached to said slide plate, said slide plate also including a slide plate cam follower received in said second cam track.

8. The carton flap engaging assembly of claim 7, said planetary disk having a first surface and defining a planetary disk cam track within said first surface, said levers including lever cam followers received in said planetary disk cam track, said planetary disk also including a planetary disk cam follower, said planetary disk cam follower received in said first cam track.

9. The carton flap engaging assembly of claim 1, said rotatable drive plate being substantially circular, and said outer edge including a circumferential edge surface, said recess being substantially circular and defining an outward opening along said circumferential edge surface, said planetary disk being substantially circular and having an outer, planetary disk circumferential edge surface which extends outwardly from said circumferential edge surface of said drive plate when said planetary disk is received with said recess.

10. A carton flap engaging assembly, comprising:

(a) a cam plate having an upper surface defining an inner cam track and an outer cam track;

(b) a drive plate disposed adjacent to said upper surface of said cam plate, said drive plate having an outer edge surface;

(c) a planetary disk mounted to said drive plate adjacent said outer edge surface, said planetary disk being selectively rotatable, said planetary disk including a planetary disk cam follower received within said outer cam track for rotating said planetary disk in response to rotation of said drive plate for tracking movement of a carton adjacent said drive plate;

(d) a carton flap engaging pin slidably mounted to said planetary disk, said carton flap engaging pin including a carton flap engaging pin cam follower received within said inner cam track for moving said carton flap engaging pin toward and away from the carton with said carton flap engaging pin being maintained substantially perpendicular to the carton by the rotation of said planetary disk as said carton flap engaging pin is moved toward and away from the carton; and (e) a motor mounted to said drive plate.

11. The carton flap engaging assembly of claim 10, said drive plate defining a first recess adjacent to said outer edge surface, and said planetary disk being received within said first recess for rotatable movement therein.

12. The carton flap engaging assembly of claim 10, said drive plate defining a passage for permitting said carton flap engaging pin cam follower to extend through said drive plate and into said inner cam track.

13. The carton flap engaging assembly of claim 10, said planetary disk defining a second recess, and said carton flap engaging pin received within said second recess.

14. The carton flap engaging assembly of claim 10, and a lever pivotally mounted to said carton flap engaging pin.

15. The carton flap engaging assembly of claim 10, said planetary disk defining a lever cam track, and a lever pivotally attached to said carton flap engaging pin, said lever including a lever cam follower extending into said planetary disk cam track.

16. The carton flap engaging assembly of claim 11, at least a portion of said planetary disk extending outwardly from said drive plate outer edge surface when said planetary disk is received within said first recess.

17. A method of engaging a carton flap in an article packaging machine of the type comprising a conveyor for moving an article group along a path of travel and for packaging said article group into the carton that is also moving along said path of travel, said method comprising:

(a) disposing adjacent said path of travel a carton flap engaging assembly, said assembly comprising a cam plate defining first and second cam tracks, a drive plate disposed adjacent said cam plate, a planetary disk mounted to said drive plate, a carton flap engaging pin mounted to said planetary disk and a motor operatively connected to said drive plate;

(b) rotating said drive plate in the direction of movement of said carton and in timed relationship with the movement of said carton along said path of travel;

(c) rotating said planetary disk in the direction of movement of said carton in response to the rotation of said drive plate so that said carton flap engaging pin is maintained substantially perpendicular to said carton along said path of travel adjacent said carton flap engaging assembly; and (d) progressively moving said carton flap engaging pin toward said carton so that said pin contacts said carton flap.

18. The method of claim 17, and thereafter (e) rotating said planetary disk in the direction opposite the direction of movement of said carton flap so that said carton engaging pin remains substantially perpendicular to said path of travel during less than 180 degrees of rotation of said drive plate.

19. The method of claim 18, and thereafter (f) rotating said planetary disk back in the direction of movement of said carton flap until said carton engaging pin is aligned with the radius of said drive plate.

20. The method of claim 17, said carton flap engaging assembly including a lever mounted to said carton flap engaging pin, and (e) moving said lever so that at least a portion of said carton flap is moved.

* * * * *

UNITED STATES PATENT AND TRADEMARK OFFICE

CERTIFICATE OF CORRECTION

PATENT NO. : 5,577,365
DATED : November 26, 1996
INVENTOR(S) : Urs Reuteler

It is certified that error appears in the above-identified patent and that said Letters Patent is hereby corrected as shown below:

The drawing sheet, consisting of Fig. 4, should be deleted to be replaced with the Fig. 4 on the attached page.

Signed and Sealed this

Thirteenth Day of January, 1998

Bruce Lehman

*Attest:*

BRUCE LEHMAN

*Attesting Officer*

*Commissioner of Patents and Trademarks*